US005645451A

United States Patent [19]

Ohsumi et al.

[11] Patent Number: 5,645,451

[45] Date of Patent: Jul. 8, 1997

[54] WATERPROOF TAP FOR A CONNECTOR

[75] Inventors: Hideki Ohsumi; Yoshinori Tomita, both of Shizuoka, Japan

[73] Assignee: Yazaki Corporation, Tokyo, Japan

[21] Appl. No.: 413,639

[22] Filed: Mar. 30, 1995

[30] Foreign Application Priority Data

Apr. 1, 1994 [JP] Japan ..... 6-065239

[51] Int. Cl.[6] ..... H01R 13/424

[52] U.S. Cl. ..... 439/587; 277/166; 277/186

[58] Field of Search ..... 439/275, 733.1, 439/589, 587, 271, 276, 586, 595; 277/2, 188 R, 136, 166, 186; 220/378

[56] References Cited

U.S. PATENT DOCUMENTS

| | | | |
|---|---|---|---|
| 4,730,836 | 3/1988 | Miller et al. | 277/233 X |
| 4,738,905 | 4/1988 | Collins | 220/378 X |
| 4,857,007 | 8/1989 | Michaels et al. | 439/589 X |
| 4,921,437 | 5/1990 | Cooper et al. | 439/587 X |
| 4,973,268 | 11/1990 | Smith et al. | 439/589 X |
| 5,076,557 | 12/1991 | Beatenbough et al. | 277/2 X |
| 5,197,898 | 3/1993 | Nagamine | 439/272 X |

FOREIGN PATENT DOCUMENTS

| | | | |
|---|---|---|---|
| 1-146478 | 10/1989 | Japan . | |
| 8705157 | 8/1987 | WIPO | 439/275 |

*Primary Examiner*—Allan N. Shoap
*Assistant Examiner*—Christopher J. McDonald
*Attorney, Agent, or Firm*—Sughrue, Mion, Zinn, Macpeak & Seas

[57] ABSTRACT

A waterproof tap for a connector is provided comprising a housing part, a waterproof tap, and a waterproof tap cover. The housing part includes a plurality of wire insertion holes and a waterproof tap storage portion arranged in a manner to surround the wire insertion holes. The waterproof tap is a flat plate member formed of elastic material and includes in its flat surface portion a plurality of wire insertion holes respectively corresponding to the wire insertion holes and a plurality of projecting portions. The waterproof tap cover includes a plurality of wire insertion holes respectively corresponding to the wire insertion holes and a plurality of projecting portion insertion holes through which the projecting portions of the waterproof tap can be inserted respectively, in such a manner that they respectively extend through the waterproof tap cover. The waterproof tap for a connector can be assembled by fitting the waterproof tap into the waterproof tap storage portion of the housing part and also by fitting the waterproof tap cover over the peripheral wall of the waterproof tap storage portion. In this assembling operation, the mounting condition of the waterproof tap can be judged by confirming the projecting condition of the projecting portions of the waterproof tap from their respective projecting portion insertion holes of the waterproof tap cover.

20 Claims, 2 Drawing Sheets

WATERPROOF TAP FOR A CONNECTOR

BACKGROUND OF THE INVENTION

1. Field of the Invention

The present invention relates to a waterproof tap for use in a connector and, in more particular, to a waterproof tap for a connector used to connect a wire harness which is used to arrange wires in various kinds of electric equipment in the interior of an automobile.

2. Related Art

A connector for a wire harness for arranging wires between various kinds of electric equipment in the interior of an automobile must be waterproof and dustproof in view of its purpose. Therefore, there are various conventional waterproof mechanisms and waterproof structures for this purpose.

For example, a waterproof electric connector disclosed in Japanese Utility Model Publication No. 1-146478 of Heisei, as shown in FIGS. 4 and 5 of the present application, includes a connector housing 31 having a plurality of terminal mounting spaces 30A to 30C, a plurality of receptacle type pressure contact terminals 33 which are respectively connected to the end portions of electric wires and can be stored in the terminal mounting spaces 30A to 30C, a plurality of seal members 34, and a cap 35.

The seal member 34 is an elastic member formed of silicone rubber and includes a plurality of through holes 36A to 36C which respectively extend through the seal member 34 and through which the electric wires 32 can be inserted. Also, the seal member 34 further includes on one surface thereof a plurality of circular recessed portions 38 which are respectively formed along the peripheral edges of the through holes 36A to 36C and also which can be respectively fitted with projecting portions 37 provided in the partition wall end portions of the connector housing 31 defining the terminal mounting spaces 30A to 30C of the connector housing 31. The seal member 34 still further includes on the other face thereof a plurality of fitting recessed portions 40 respectively fittable with projecting portions 39 provided in the cap 35.

The electric wires 32 are inserted sequentially through the cap 35, the through holes 36A to 36C of the seal member 34, and the terminal mounting spaces 30A to 30C of the connector housing 31. The receptacle type pressure contact terminals 33 provided in the end portions of the electric wires 32 are stored in the terminal mounting spaces 30A to 30C of the connector housing 31. The circular recessed portions 38 of the seal member 34 are fitted with the projecting portions 37 of the connector housing 31, and the projecting portions 39 of the cap 35 are fitted into the fitting recessed portions 40 of the seal member 34, thereby completing a waterproof electric connector 41.

According to the waterproof electric connector 41, due to the fact that the circular recessed portions 38 of the seal member 34 are respectively fitted with the projecting portions 37 of the connector housing 31 and also the fitting recessed portions 40 are respectively fitted with the projecting portions 39 of the cap 35, the inner peripheral surfaces 42 of the connector 41 forming the through holes 36A to 36C are respectively deformed inwardly to thereby reduce their respective diameters, with the result that the insulating covered portions of the electric wires 32 are closely contacted with the inner peripheral surfaces 42 to thereby be able to secure a sealed condition between them.

However, in the waterproof electric connector 41 having the above-mentioned structure, when the cap 35 is mounted onto the connector 41, it is not possible to confirm the fitting state between the circular recessed portions 38 of the seal member 34 and the projecting portions 37 of the connector housing 31 and the fitting state between the fitting recessed portions 40 and the projecting portions 39 of the cap 35. Therefore, it is not possible to confirm whether or not the electric wires 32 are in close contact with the through holes 36A to 36C of the seal member 34.

Because the sealing performance of the electric wire 32 depends greatly on the contact state between the inner peripheral surfaces 42 of the seal member 34 and the electric wire 32, if the projecting portions 37 of the connector housing 31 as well as the projecting portions 39 of the cap 35 are not fitted deeply enough into the circular recessed portions 38 of the seal member 34 and the fitting recessed portions 40, then a sufficient pressing force cannot be obtained by means of the inner peripheral surfaces 42 of the seal member 34. This makes it impossible to confirm the fitting state and thus there is a possibility that a sufficient sealing performance is not provided. This is not favorable in controlling the quality of products.

Also, as described above, the method of sealing the electric wires 32 relies on the close fitting between the projecting portions 37 of the connector housing 31 and the circular recessed portions 38 of the seal member 34 as well as the close fitting between the projecting portions 39 of the cap 35 and the fitting recessed portions 40 of the seal member 34. Therefore, to obtain a good sealing performance, it is preferred that these mutually mating components be arranged at mutually corresponding positions. That is, these components must be formed with a relatively high degree of accuracy.

Further, since the seal member 34, as shown in FIG. 5, is arranged such that the circular recessed portions 38 and the fitting recessed portions 40 are so formed as to oppose each other, an operator can carelessly mistake the circular recessed portions 38 for the fitting recessed portions 40 in mounting the seal member 34 onto the connector housing 31. Therefore, it is possible that the seal member may not be mounted correctly to the connector housing. Also, because the seal member 34 is formed of rubber and thus can be easily deformed, it is possible to put the cap 35 on the seal member 34 in such an incorrect mounting condition. As a result of this, there is a possibility that such an incorrectly mounted connector may be used in the wire harness. If this occurs, the expected sealing performance cannot be provided.

SUMMARY OF THE INVENTION

The present invention aims at eliminating the drawbacks found in the above-mentioned conventional waterproof tap for a connector. Accordingly, it is an object of the invention to provide a waterproof tap for a connector which can provide excellent sealing performance, can confirm the mounting state when assembling, and can prevent incorrect mounting of the waterproof tap.

In attaining the above object, according to the invention, there is provided a waterproof tap for a connector, which comprises a housing part including a plurality of wire insertion holes formed in one surface thereof and a plurality of terminal storage chambers respectively formed internally of the wire insertion holes in communication with the wire insertion holes. A waterproof tap is provided including a plurality of wire insertion holes extending therethrough and corresponding to the wire insertion holes of the housing part, and also including a projecting portion. A waterproof tap cover is also provided including a plurality of wire insertion holes respectively corresponding to the wire insertion holes of the waterproof tap and a plurality of projecting portion insertion holes through which the projecting portions of the waterproof tap can be inserted, the wire insertion holes and the projecting portion insertion holes respectively extending through the waterproof tap cover. The projecting portions of the waterproof tap project out from the projecting portion insertion holes of the waterproof tap cover on completion of assembly of the waterproof tap.

Also, similarly, in attaining the above object, according to the invention, there is provided a waterproof tap for a connector, which comprises a housing part including a plurality of wire insertion holes formed in one surface thereof and a plurality of terminal storage chambers respectively formed internally of the wire insertion holes in communication with the wire insertion holes. A waterproof tap is provided including a plurality of wire insertion holes extending therethrough and corresponding to the wire insertion holes of the housing part, and also including a plurality of projecting portions. A waterproof tap cover is also provided including a plurality of wire insertion holes respectively corresponding to the wire insertion holes of the waterproof tap and a plurality of projecting portion insertion holes through which the projecting portions of the waterproof tap can be inserted, the wire insertion holes and the projecting portion insertion holes respectively extending through the waterproof tap. The waterproof tap cover includes, on the opposite surface thereof to the surface facing the housing part, a plurality of recessed portions so formed as to adjoin continuously the above projecting portion insertion holes and, on completion of assembly of the waterproof tap for a connector, the projecting portions of the waterproof tap projected out from their respective recessed portions of the waterproof tap cover.

According to the waterproof tap for a connector of the invention, since the projecting portions are provided in the waterproof tap and the projecting portion insertion holes for insertion of the projecting portions are formed in the waterproof tap cover as to extend through the waterproof tap cover, when assembling, the waterproof tap can be mounted to the housing part with no possibility that the mounting direction thereof is mistaken. Also, because the leading end portion of the waterproof tap is projected out from the projecting portion insertion hole of the waterproof tap cover or from the recessed portion so formed as to adjoin continuously the projecting portion insertion hole when the assembling of the waterproof tap for a connector is completed, the mounting state of the waterproof tap can be confirmed visually, which can improve the efficiency of the assembling operation as well as the yield of the products.

Now, description will be given below in detail of a waterproof tap for a connector according to the invention with reference to FIGS. 1 to 3.

DESCRIPTION OF THE PREFERRED EMBODIMENT

Figure 1:
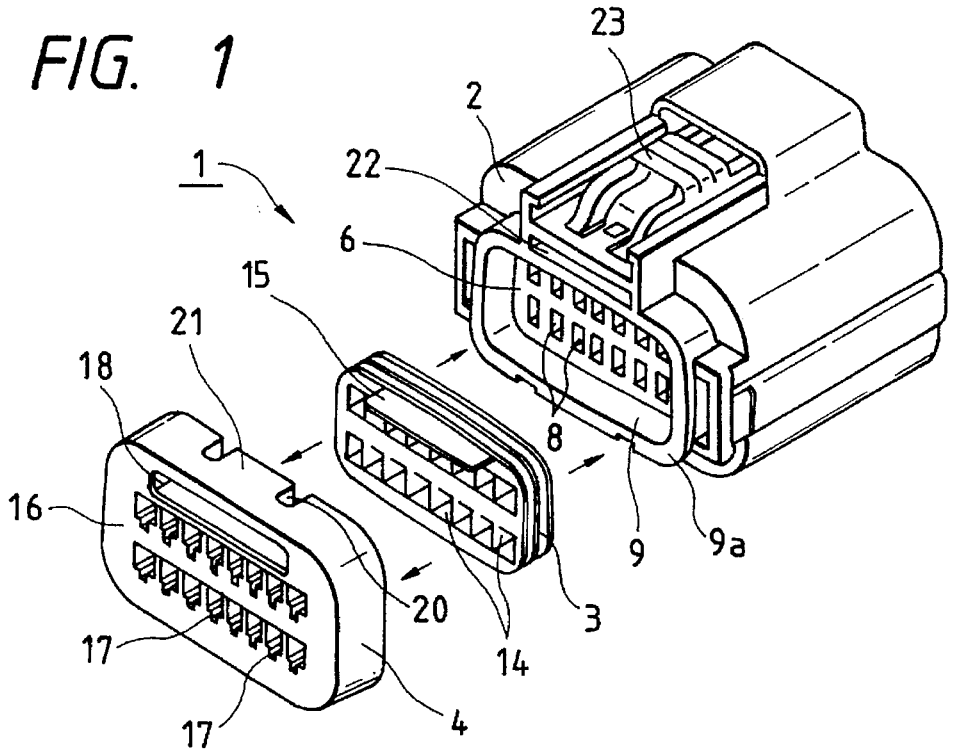
FIG. 1 is a perspective view of the structure of a first embodiment of a waterproof tap for a connector according to the invention.

Referring to FIG. 1, the waterproof tap device for a connector 1 includes a housing part 2, a waterproof tap 3, and a waterproof tap cover 4. To assemble the waterproof tap device, the waterproof tap 3 is mounted to the housing part 2 and the waterproof tap cover 4 is further fitted over the waterproof tap 3.

Figure 2:
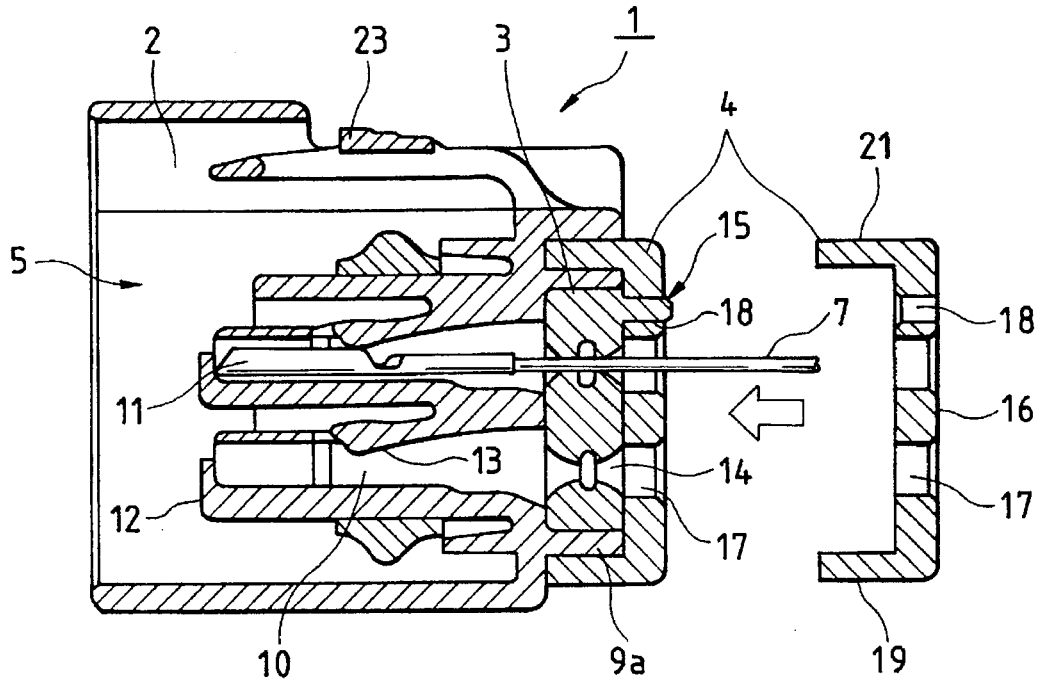
FIG. 2 is a section view of the main portions of the waterproof tap for a connector shown in FIG. 1, showing the assembling state thereof.

The housing part 2 is formed of insulation material such as synthetic resin or the like in a substantially rectangular cylinder and, as shown in FIG. 2, the housing part 2 includes in one surface thereof an opening 5 into which a mating connector (not shown) can be inserted. In the surface of the housing part 2 opposed to the opening, there are formed a plurality of wire insertion holes 8 through which electric wires 7 can be inserted, and also there is formed a waterproof tap storage portion 9 into which the waterproof tap 3 (which will be described later) can be fitted. The waterproof tap storage portion 9 includes a peripheral wall 9*a* which surrounds the wire insertion holes 8.

Also, in the interior of the housing 2, as shown in FIG. 2, there are formed a plurality of terminal storage chambers 10 which are respectively in communication with the wire insertion holes 8. The terminal storage chambers 10 are respectively formed in almost polygonal spaces which can independently store therein elastic terminals 11 connected to the end portions of the electric wires 7. Each of the terminal storage chambers 10 includes in the bottom surface end portion thereof a stand-up portion 12 which serves also as a positioning member for positioning the elastic terminal 11 when the waterproof tap for a connector 1 is assembled, and also includes in the upper surface thereof an elastic securing projection 13 which suspends down toward the above bottom surface and also which, when the elastic terminal 11 is stored, presses against the elastic terminal 11 toward the bottom surface and holds the same. In the foregoing description, only one electric wire 7 is shown in the drawings; however, normally, the same number of electric wires 7 as the number of the wire insertion holes 8 are connected to the housing part 2.

The above-mentioned waterproof tap 3 is a flat-plate-like member which has a thickness equal to the height of the peripheral wall 9*a* forming the waterproof tap storage portion 9 of the housing part 2 and is formed of elastic material such as rubber in the same shape as the opening of the waterproof tap storage portion 9. Also, the waterproof tap 3 includes in the flat surface portion thereof a plurality of wire insertion holes 14 which respectively extend through the waterproof tap 3 and correspond to the wire insertion holes 8 formed in the housing part 2. Each of the wire insertion holes 14, as shown in FIG. 2, has a sectioned shape which is gradually reduced in diameter toward the thick central portion thereof so that it can hold the electric wire 7 at the central portion thereof.

Also, on one surface of the waterproof tap 3, there are erected a plurality of projecting portions 15. In particular, each of the projecting portions 15 is formed, for example, in a flat plate shape, has a projecting height set slightly greater than the thickness of a waterproof tap cover 4 (which will be described later), and is erected in parallel to the associated wire insertion hole 14.

The waterproof tap cover 4 is a cover member which is formed of insulation material such as synthetic resin or the like. The cover 4 includes in the cover-like upper wall 16 a plurality of wire insertion holes 17 which respectively extend through the upper wall 16 and correspond to the insertion holes 8 and 14 respectively formed in the housing part 2 and waterproof tap 3. Further, in the upper wall 16, there are formed a plurality of projecting portion insertion holes 18 which respectively extend through the upper wall 16 and through which the projecting portions 15 provided in the waterproof tap 3 can be inserted respectively.

Also, the waterproof tap cover 4 further includes a side wall 19. That is, if the side wall 19 of the waterproof tap cover 4 is fitted over the peripheral wall 9*a* forming the waterproof tap storage portion 9 of the housing part 2, then the tap cover 4 can be connected to the housing part 2 in a unified body. In this fitting, if the side wall 19 is partially cut to form a cut-away portion 20 to thereby provide a securing projecting piece 21 and the peripheral wall 9*a* of the housing part 2 is recessed on the outside thereof to form an engaging recessed portion 22 in which the securing projecting piece 21 can be fitted, and if the securing projecting piece 21 is fitted into the engaging recessed portion 22, then the waterproof tap cover 4 and housing part 2 can be unified together and thus can be held more firmly.

Next, a description will be given below of a procedure for assembling the above-mentioned waterproof tap device for a connector 1 with reference to FIG. 2.

At first, the electric wire 7 is inserted through the wire insertion holes 14 and 17 respectively formed in the waterproof tap 3 and waterproof tap cover 4, the elastic terminal 11 is connected by pressure or the like to the leading end portion of the electric wire 7 to thereby form the leading end portion of the electric wire 7 into a terminal-like portion, and the elastic terminal 11 is then inserted into the wire insertion hole 8 of the housing part 2 and is stored into the terminal storage chamber 10. During this operation, if the electric wire 7 is inserted through the wire insertion hole 14 from the side on which the projecting portion 15 of the waterproof tap 3 is provided to then it is possible to prevent the waterproof tap 3 from being mounted to the housing part 2 incorrectly. Also, if the electric wire 7 is pushed in until the leading end of the elastic terminal 11 is abutted against the stand-up piece 12 of the terminal storage chamber 10, then the elastic terminal 11 can be properly positioned.

Next, the waterproof tap 3 is fitted into the waterproof tap storage chamber 9 of the housing part 2. Since the waterproof tap 3 is an elastic member, when the electric wire 7 is inserted, the waterproof tap 3 is slightly swollen outwardly. Thus, if the waterproof tap is fitted into the waterproof tap storage portion 9 of the housing part 2, then the waterproof tap 3 can hold the electric wire 7 more securely and also its sealing contact with the peripheral wall 9*a* of the waterproof tap storage portion 9 can be improved, so that a higher sealing effect can be obtained.

Thereafter, the side wall 19 of the waterproof tap cover 4 is fitted over the peripheral wall 9*a* forming the waterproof tap storage portion 9 of the housing part 2, and the securing projecting piece 21 is fitted into the engaging recessed portion 22 of the housing part 2 to thereby unify the waterproof tap cover 4 and housing part 2, which completes the assembling of the waterproof tap device.

Here, as shown in FIG. 2, in a state in which the waterproof tap 3 and waterproof tap cover 4 are mounted to the housing 2 in a specified manner, the leading end of the projecting portion 15 of the waterproof tap 3 projects outwardly from the projecting portion insertion hole 18 of the waterproof tap cover 4. Therefore, the mounting state of the waterproof tap 3 can be judged easily by confirming visually the projecting condition of the projecting portion 15 from the projecting portion insertion hole 18 of the waterproof tap cover 4.

Next, description will be given below of a second embodiment of a waterproof tap for a connector 1 according to the invention with reference to FIG. 3. In the second embodiment, a housing part 2 is similar to the housing part 2 employed in the above-mentioned first embodiment. For this reason, the parts thereof are given the same designations and thus the description of the parts and resulting structure is omitted.

Figure 3:
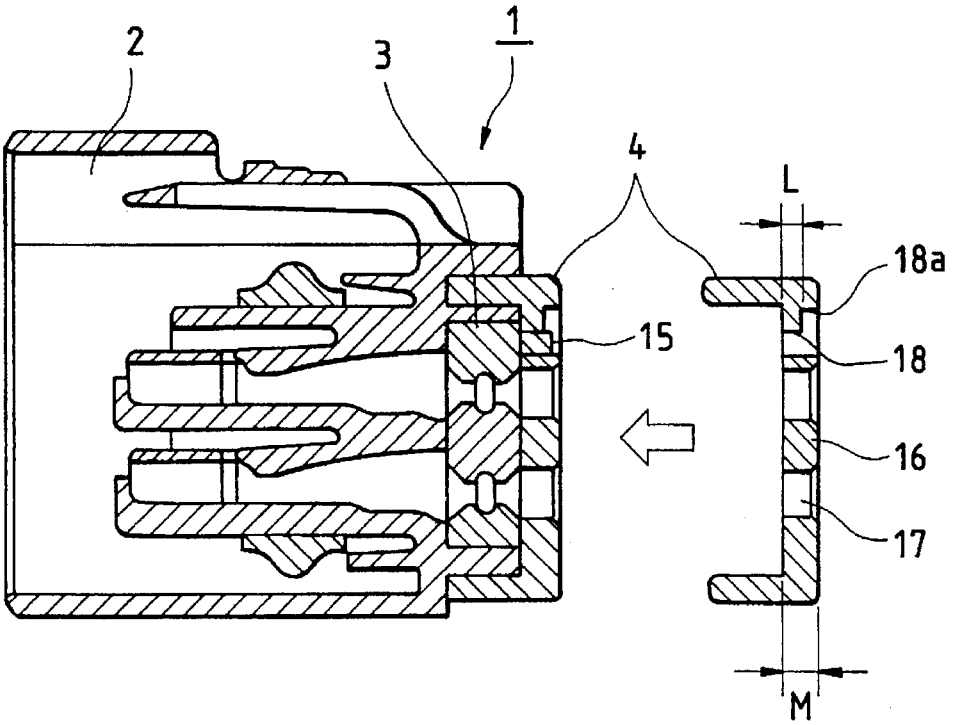
FIG. 3 is a section view of the main portions of a second embodiment of a waterproof tap for a connector according to the invention.
Figure 4:
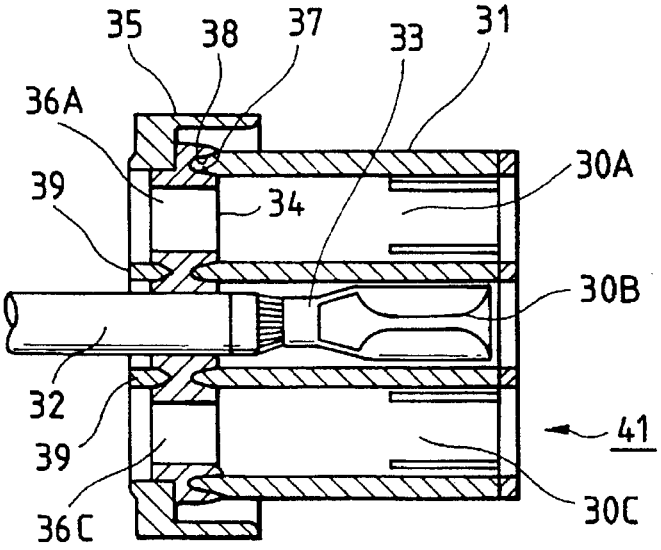
FIG. 4 is a section view of the main portions of a conventional waterproof electric connector.
Figure 5:
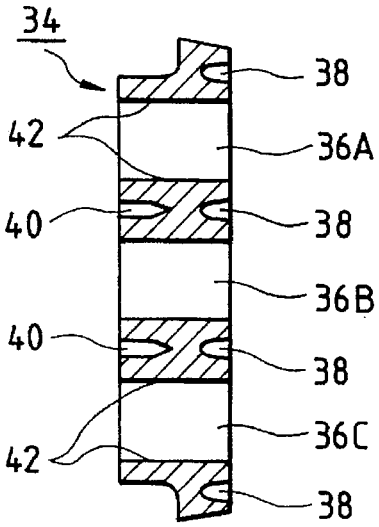
FIG. 5 is a section view of a seal member employed in the waterproof electric connector shown in FIG. 4.

As shown in FIG. 3, the waterproof tap cover 4 includes on the surface of the upper wall 16 a projecting portion insertion hole 18 and a recessed portion 18*a* formed continuously with the projecting portion insertion hole 18.

On the other hand, a projecting portion 15 provided in the waterproof tap 3 is designed such that the projecting height thereof is equal to or greater than the thickness (L) of the portion forming the projecting portion insertion hole 18 in the upper wall 16 of the waterproof tap cover 4 and is equal to or smaller than the thickness (M) of the portion forming the wire insertion hole 17.

When assembling the waterproof tap device, in a state in which the waterproof tap 3 and waterproof tap cover 4 are mounted to the housing part 2 in a specified manner, the leading end portion of the projecting portion 15 of the waterproof tap 3 projects outwardly from the projecting portion insertion hole 18 formed in the recessed portion 18*a* of the waterproof tap cover 4 but will never project beyond the surface of the upper wall 16 of the waterproof tap cover 4. Therefore, the mounting condition of the waterproof tap 3 can be confirmed through the recessed portion 18*a* of the waterproof tap cover 4.

Further, according to the invention, other various modifications are possible. For example, on the upper surface of the housing part 2, there can be provided a lock member 23 which can be secured to a connector holder (not shown). Also, if the peripheral surface of the waterproof tap 3 is machined into a corrugated shape, then the waterproof tap 3 can be fitted into the waterproof tap storage portion 9 more easily and also the close contact state between the waterproof tap 3 and the peripheral wall 9*a* of the waterproof storage portion 9 can be improved.

As has been described heretofore, according to the waterproof tap for a connector of the invention, since a plurality of projecting portions are provided in the waterproof tap and, in the waterproof tap cover, there are formed a plurality of projecting portion insertion holes which extend through the tap cover and through which the projecting portions can be inserted, when assembling the waterproof tap device, the waterproof tap can be mounted to the housing part with no possibility of the tap being position in an inverted manner. Also, because complete assembling of the waterproof tap device occurs when the leading end portion of the waterproof tap projects from the projecting portion insertion hole of the waterproof cover, the mounting condition of the waterproof tap can be confirmed visually, so that the efficiency of the assembling operation as well as the yield of the products can be greatly improved.

What is claimed is:

1. A waterproof tap device for a connector, comprising:

a housing part including a plurality of housing part wire insertion holes formed in one surface thereof and a plurality of terminal storage chambers in communication with said wire insertion holes;

a waterproof tap including a plurality of waterproof tap wire insertion holes, respectively corresponding to said housing part wire insertion holes, extending through said waterproof tap, and further including a projecting portion; and a waterproof tap cover including a plurality of waterproof tap cover wire insertion holes respectively corresponding to said housing part wire insertion holes and said waterproof tap wire insertion holes, and further including a projecting portion insertion hole through which said projecting portion of said waterproof tap can be inserted, said waterproof tap cover wire insertion holes and said projecting portion insertion hole extending through said waterproof tap cover, wherein said projecting portion of said waterproof tap protects through said projecting portion insertion hole only when assembly of said waterproof tap for a connector is properly completed.

2. A waterproof tap device for a connector as claimed in claim 1, wherein said waterproof tap cover further includes a recessed portion formed continuously with said projecting portion insertion hole on the surface of said tap cover opposite the surface thereof facing said housing part, and said projecting portion of said waterproof tap respectively project through said recessed portion of said waterproof tap cover when assembly of said waterproof tap for a connector is completed.

3. A waterproof tap device for a connector as claimed in claim 1, wherein said housing part further includes a peripheral wall surrounding said housing part will insertion holes, thereby defining a storage portion for receiving said waterproof tap.

4. A waterproof tap device for a connector as claimed in claim 3, wherein said peripheral wall has a height substantially equal to a thickness of said waterproof tap.

5. A waterproof tap device for a connector as recited in claim 1, wherein said projecting portion has a height which is greater than a thickness of said waterproof tap cover.

6. A waterproof tap device for a connector as claimed in claim 3, wherein said waterproof tap cover further includes a side wall for fitting over said peripheral wall.

7. A waterproof tap device for a connector as claimed in claim 6, wherein said side wall is partially cut thereby forming a securing projecting piece and wherein said peripheral wall further includes an engaging recessed portion, said securing projecting piece being insertable into said engaging recessed portion, thereby securing said waterproof tap cover to said housing part.

8. A waterproof tap device for a connector as claimed in claim 1, wherein said waterproof tap is formed of an elastic material.

9. A waterproof tap device for a connector as claimed in claim 1, wherein said tap cover is formed of synthetic resin.

10. A waterproof tap device for a connector as claimed in claim 2, wherein said housing part further includes a peripheral wall surrounding said housing part wire insertion holes, thereby defining a storage portion for receiving said waterproof tap.

11. A waterproof tap device for a connector as claimed in claim 10, wherein said peripheral wall has a height substantially equal to a thickness of said waterproof tap cover.

12. A waterproof tap device for a connector as claimed in claim 2, wherein said projecting portion has a height which is greater than a thickness of said projecting portion insertion hole.

13. A waterproof tap device for a connector as claimed in claim 12, wherein said height of said projecting portion is equal to or smaller than a thickness of said waterproof tap cover.

14. A waterproof tap device cover for a connector as claimed in claim 10, wherein said waterproof tap cover further includes a side wall for fitting over said peripheral wall.

15. A waterproof tap device for a connector as claimed in claim 14, wherein said side wall is partially cut thereby forming a securing projecting piece and wherein said peripheral wall further includes an engaging recessed portion, said securing projecting piece being insertable into said engaging recessed portion, thereby securing said waterproof tap cover to said housing part.

16. A waterproof tap device for a connector as claimed in claim 2, wherein said waterproof tap is formed of an elastic material.

17. A waterproof tap device for a connector as claimed in claim 2, wherein said tap cover is formed of synthetic resin.

18. A waterproof tap device for a connector as claimed in claim 1, wherein said waterproof tap further comprises a peripheral surface machined into a corrogated shape.

19. A waterproof tap device for a connector as claimed in claim 2, wherein said waterproof tap further comprises a peripheral surface machined into a corrogated shape.

20. A waterproof tap device for a connector as claimed in claim 1, wherein said waterproof tap has said projecting portion prior to assembly of said waterproof tap device.

* * * * *